US006135318A

United States Patent [19]

Valley

[11] Patent Number: 6,135,318

[45] Date of Patent: Oct. 24, 2000

[54] VARIABLE RATE CLOSURE FOR DISPENSERS HAVING FLUID CONTENTS

[75] Inventor: Joseph P. Valley, Hopatcong, N.J.

[73] Assignee: Stull Technologies, Somerset, N.J.

[21] Appl. No.: 08/947,355

[22] Filed: Oct. 8, 1997

[51] Int. Cl.[7] ..... B67D 5/22

[52] U.S. Cl. ..... 222/48; 222/521

[58] Field of Search ..... 222/44, 46, 48, 222/521

[56] References Cited

U.S. PATENT DOCUMENTS

| | | | |
|---|---|---|---|
| 3,326,426 | 6/1967 | Porter et al. | 222/521 |
| 3,598,285 | 8/1971 | Stull | 222/48 |
| 4,927,065 | 5/1990 | Beck | 222/521 X |

*Primary Examiner*—Gregory L. Huson
*Attorney, Agent, or Firm*—Friedman Siegelbaum LLP

[57] ABSTRACT

A closure for the dispensing contents within a dispenser, generally comprises a post projecting upwardly from a base and a closure cap. The post has an upper solid portion, including a notch to facilitate multiple dispensing rates of the closure, connecting segments between the upper and lower portions and a cam follower. In a first dispensing position, the contents are dispensed only out of the notch. A closure cap is rotatably mounted for movement along at least a portion of the post. The post extends beyond the top of the cap in the closed position. The cap has a cam for movement of the cap with respect to said cam follower to facilitate rotation of the cap along the post. In a second dispensing position of the closure, the contents are dispensed through an upper orifice of the cover cap.

18 Claims, 4 Drawing Sheets

VARIABLE RATE CLOSURE FOR DISPENSERS HAVING FLUID CONTENTS

FIELD OF THE INVENTION

The present invention is directed generally to dispensers and more specifically to closures for dispensers which permit flow of the material from the dispenser at variable rates.

BACKGROUND OF THE INVENTION

Closures are of course very well known. Examples of closures are found, for instance, in U.S. Pat. Nos. 3,194,453 (Cherba), 3,123,259 (Musel), 3,326,425 (Porter), 3,406,880 (Stull), 3,406,880 (Stull), 3,598,285 (Stull), 3,981,421 (McDowell), 4,438,870 (Stull), 4,754,899 (Stull), 4,773,572, (Stull), 4,842,169 (Stull), 4,927,065 (Beck) and 4,967,941 (Beck).

The Porter patent is directed to a closure cap with a very small dispensing orifice and which reduces the amount of fluid near the outlet hole of the cap when the hole is closed off by a closure pin mounted on the nozzle. Specifically, the patent discloses a central upstanding post 18 with a slot 20 opening to the top surface of the post and a cap body 26 mounted to the post. FIG. 1 of the Porter patent shows the container closure cap in a closed position. FIG. 2 shows the cap in a fully open position FIG. 3 shows the cap in a semi-closed position. In at least one dispensing position, the cap body inner periphery clears the top surface of the post. The Porter patent discloses a small dispensing orifice as it has a large post with a notch. The Beck '065 patent, like the Porter patent, shows a central post 14 having a slot 26 along a substantial length of an upper portion thereof opening to a top surface 28. Both the Porter and Beck '065 patents show:

(a) a cap body reciprocally mounted on the central post and having an inner periphery which cooperates with:
  (i) the peripheral wall; and
  (ii) at least one slot to provide a closed position with a least one slot being above the cap body inner periphery; and (b) at least two dispensing positions for dispensing the contents at least of two different rates. In one position, the cap body inner periphery clears the top surface as the cap body is moving along the post away from the closed position.

The Beck '941 patent is directed to a twist lock adjustable measuring closure cap for dispensing the contents of a container having a central post 14, including a top surface and a substantially imperforate wall 44 having an opening 68 on the top surface for metering the contents to be dispensed. A cap body 10 with an inner peripheral wall is reciprocally mounted on the post 14 for a variable opening between the cap inner periphery and the post peripheral wall to provide a closure position and a dispensing position as the cap body 10 moves away from the closure position. The '941 patent also discloses "detents" which provide for positional indication during movement of the cap body that it has reached a closure position or the dispensing position.

Despite the existence of such prior art, the prior art Porter and the two Beck patents do not disclose a substantially large dispensing orifice for better flow of the contents to be dispensed or for dispensing thicker contents. It is therefore an object of the invention to provide a closure having a substantially large dispensing orifice for better flow and/or for use when dispensing thicker contents.

Another object of the invention is to provide a closure with a written visible indicator to the user of the correct dispensing position.

Still another object of the invention is to provide a closure have multiple dispensing positions without additional detents in a post.

Yet another object of the invention is to provide a closure which is more economical than certain prior art closures.

SUMMARY OF THE INVENTION

These and other objects of the invention, which shall be understood hereafter, are achieved by the Variable Rate Dispenser Closure which includes at least three closure positions including a "closed" position and at least a first (I) and second (II) dispensing positions. The closure is opened by turning cap counter-clockwise from the closed position to positions I and II.

As the cap is rotated counterclockwise, a cam on the cap pushes downwardly on a cam follower on the closure's central post. The cam has first slope, a first horizontal "resting" position, a second slope and a second horizontal resting positions. The resting positions correspond to dispensing positions I and II respectively. Written indication on the base of the central post depicts whether the cap is in the "closed," "I" or "II" positions.

Just beyond the second resting position is a perpendicular wall which prevents the cap from opening further and thereby being unwantedly removed from the post. Similarly, just before the closed position is a wall which prevents the cap from being twisted in the wrong direction (i.e., clockwise).

BRIEF DESCRIPTION OF THE DRAWINGS

The invention will be better understood by the Detailed Description of the Preferred and Alternate Embodiments, with reference to the drawings, in which.

DETAILED DESCRIPTION OF THE PREFERRED AN ALTERNATE EMBODIMENTS

Figure 1:
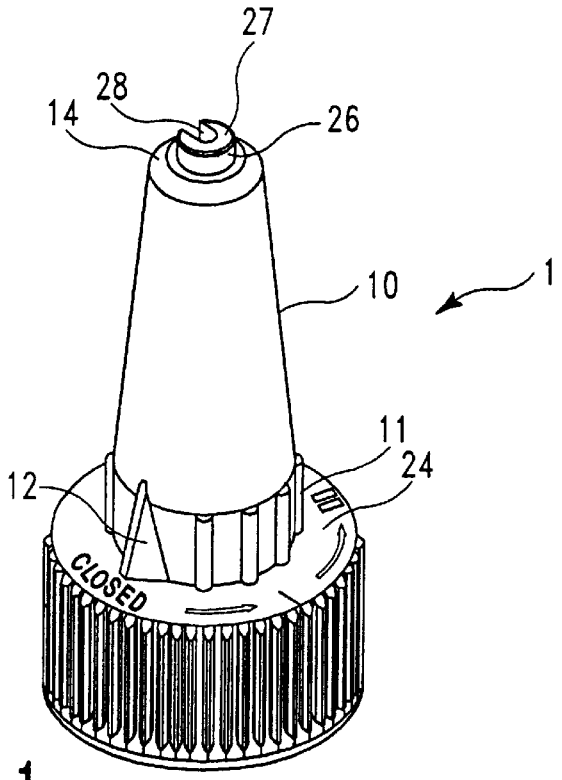
FIG. 1 is a front respective view of the closure depicted in a closed position.
Figure 2:
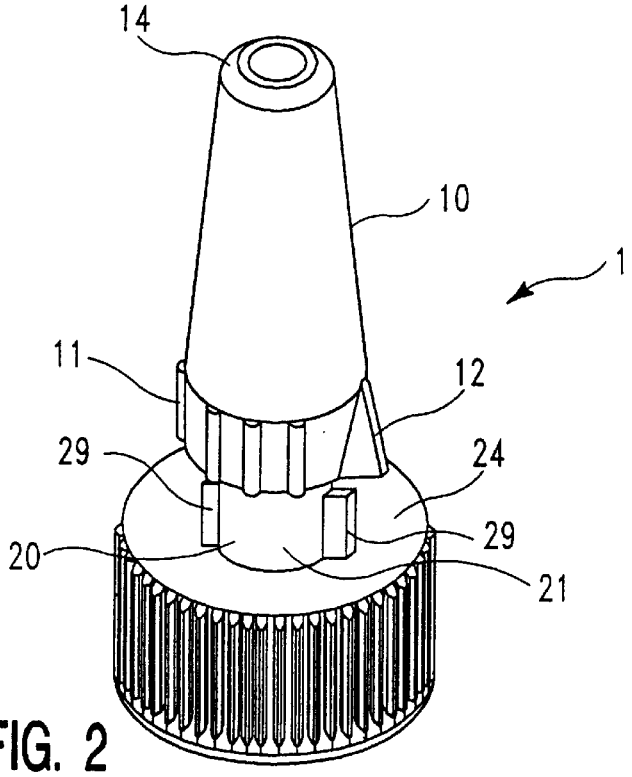
FIG. 2 is another perspective view of the FIG. 1 closure, but depicted in a fully-opened positions.

Referring now to the drawings, wherein like numerals reflect light elements throughout the various views, FIGS. 1 and 2 depict closure cap 1 for a dispenser, generally comprising cap 10 and central post 20. The dispensers could be virtually any type of dispenser—e.g., for glue, caulking, etc. The cap 10 is reciprocally mounted on the central post as explained further herein.

FIG. 2 depicts the cap in a fully-opened position. The cap 10 may be moved into an open position simply by rotating it counterclockwise from the "closed" position as shown in FIG. 1, to a semi-opened I or fully-opened position II as shown in FIG. 2.

Figure 3A:
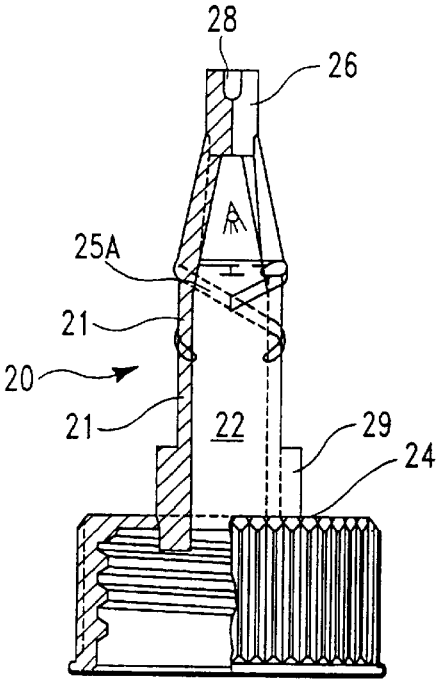
FIGS. 3A and 3B are partially cross-sectional views of the central post of the closure.
Figure 3B:
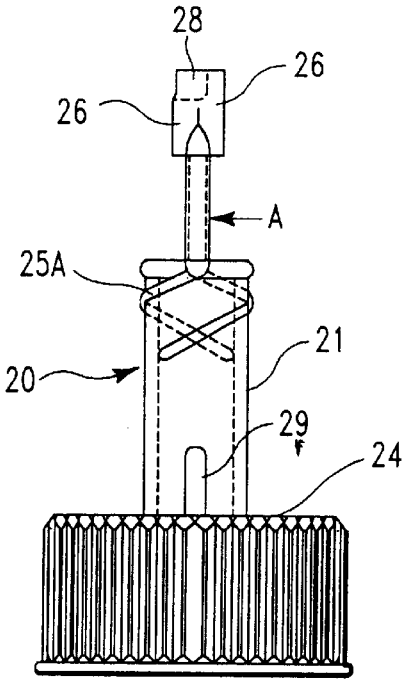

The central post 20 is best depicted in FIGS. 3A and 3B and extends upwardly from base 24. The post 20 has an upper cylinder portion 26 and lower cylinder position 21 and connecting segments 23A and 23B between the upper and lower portions 21, 26 to create a triangular open area A (see also FIG. 7). The triangular vertically oriented open area creates a substantial departure from patents like the Beck patents. Such configuration creates a larger dispensing area because the area in the Beck structures is only as large as the flat planar distance between "inner" and "outer" cylindrical structures of the post. By moving the "inner" cylinder portion "upwardly", it becomes an "upper" cylinder portion 26 and a larger opening for dispensing is created.

The lower cylindrical portion 21 has an aperture 22 extending through the cylindrical segment and beginning at the base 24 of the central post 20 to the top thereof which also has an extended "lip" 27. Spiral twist guides 25A project slightly outwardly from the central post to guide corresponding spiral guides 25B (see FIG. 5) in the closure cap 10. Projecting outwardly from near the bottom of lower portion 21 of are two cam followers 29 which cooperate with a cam 50 in the cap, as better depicted in FIG. 5 and explained herein.

Figure 6C:
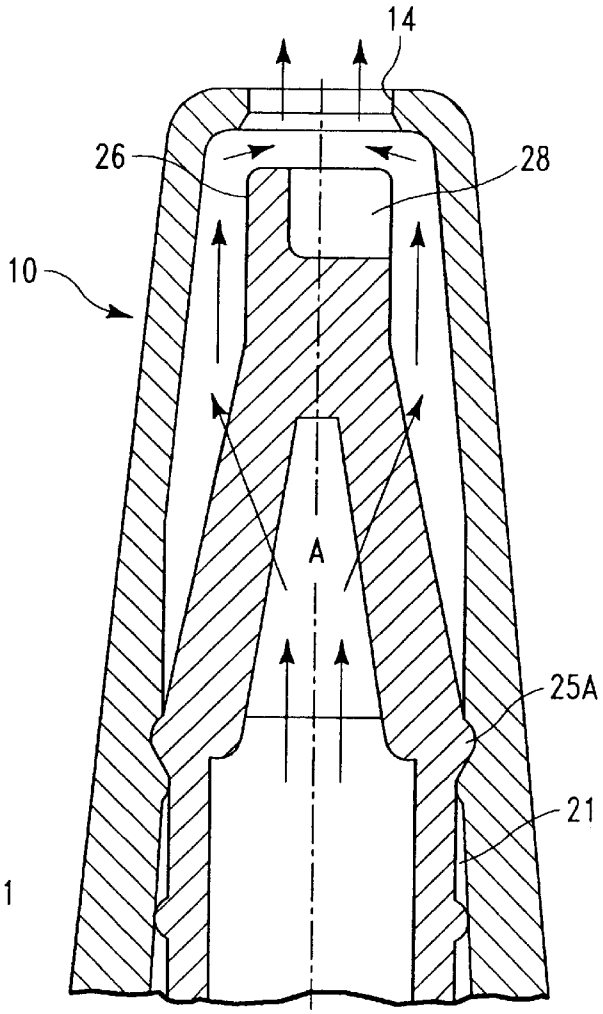
FIGS. 6A, 6B and 6C are a cross-sectional views of the closure in a closed, semi-opened and fully opened position respectively.
Figure 6B:
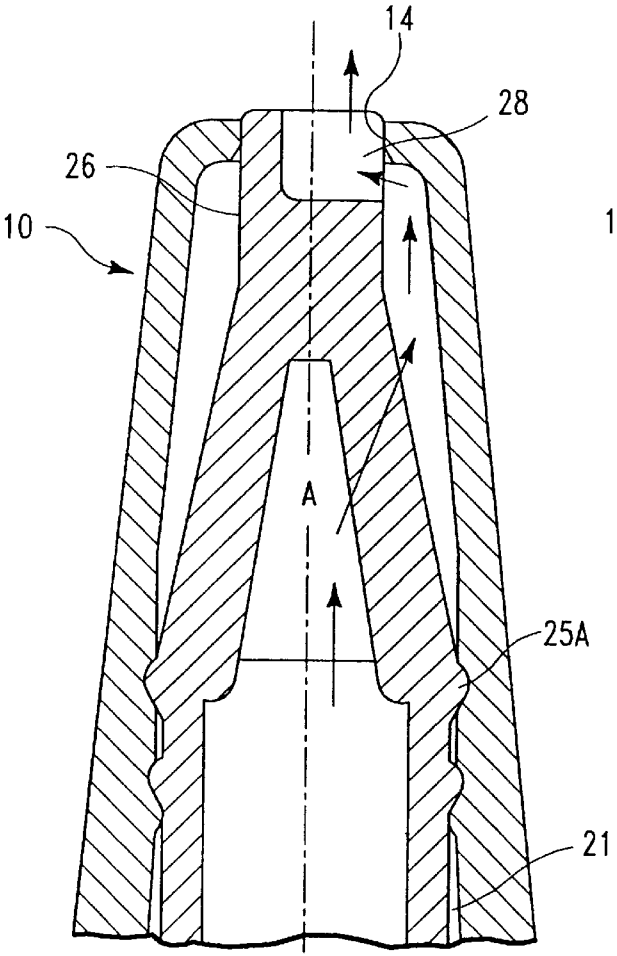
Figure 6A:
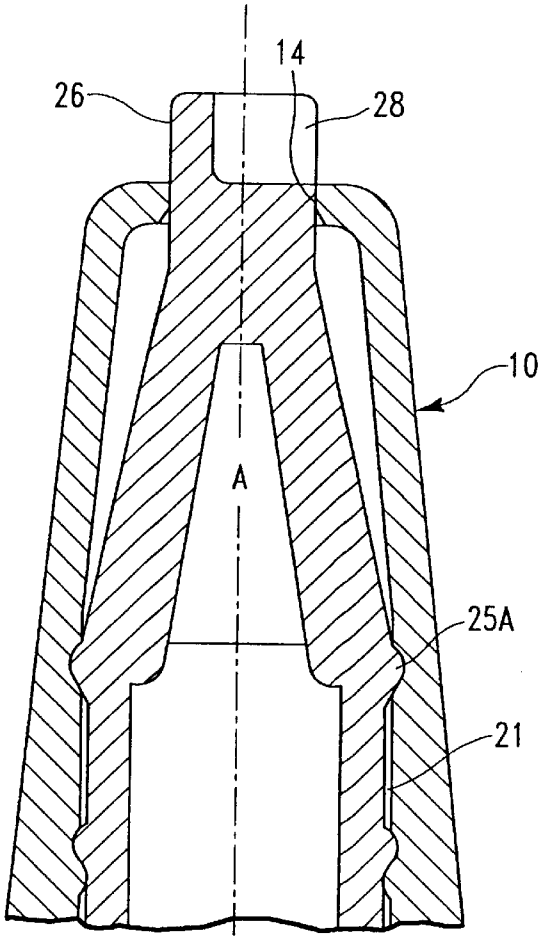

The upper segment 26 of the post 10 has a cylindrical surface with a notch 28 (see FIGS. 3A and 3B) cut out therefrom. As FIG. 6A clearly demonstrates, notch 28 facilitates flow of the material in small amounts when the closure is in position I. In this position, the contents are dispensed only through the notch. By contrast, in the second position as shown in FIG. 6C, large amounts of the contents are dispensed through the upper orifice 14 of the cover cap.

Figure 5:
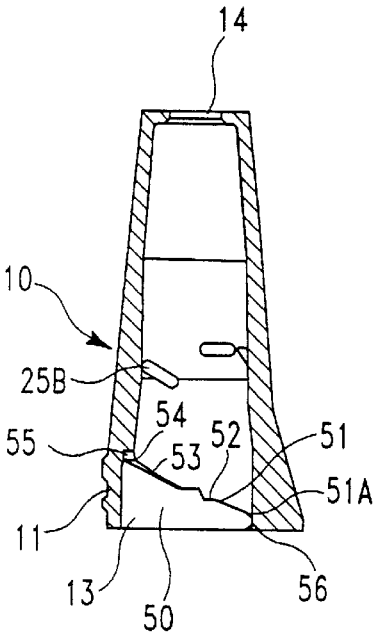
FIG. 5 is a cross-sectional view of the cap of the closure depicting the cam mechanism.

The closure cap 10 as depicted in FIGS. 1, 2, and 5, has gripping projections 11 which facilitate twisting of the cap 10 about the central post 20 and its consequent upward movement thereon. The cap 10 has a projecting triangular wedge 12 which serves as a pointing indicator of whether the cap is in the closed, I or II position. The cap has a lower aperture 13 and upper aperture 14 and is conical in shape. The apertures 13 and 14 facilitate the insertion of the central post 20 therein. As depicted in FIG. 1, in the closed position, the upper segment 26 of the central post 20 extends beyond the top 14 of the closure cap 10.

When twisted clockwise or counterclockwise, the cap moves along the twist guides 25A and 25B (see FIGS. 3A, 3B and 5) and upward along the post 20 to discrete positions I and II (as shown in FIG. 2). The movement is facilitated by the cam follower 29 moving along cam 50 as cap 10 is twisted counterclockwise from the closed position to positions I and II. In the prior art, the cam mechanisms were on the post and not in the cap.

It has been demonstrated that placing cam 50 inside the cap makes the closure cap much more economical. In traditional designs, a steel component would make the thread and the cam. The post is also constructed by a steel component. Removing the cam design from the post and placing it in the cap decreases the overall cost of manufacturing the closure because:

(a) the component that forms the lower cylinder 21 is much simpler because all that is required besides the portions needed to make the thread and lip is a slot to create the cam follower 29;

(b) by contrast, to make a more traditional post with a cam at the base thereof, the component must be much more complex at the bottom, increasing the cost of production on an already expensive and delicate component. This complicated configuration requires a more complicated machinery process such as electrical discharge machinery (EDM) which burns away what is not desired and is very costly; and (c) since the cover cap is a smaller component, to equal your output with the base and the cover cap, one would build a smaller cavitation on the cover cap than on the base cap, because it would be a faster cycle because it is made of plastic. Because of the smaller cavitation on the cover, there would be a cost savings by putting the complicated configuration in the cover cap.

Figure 4:
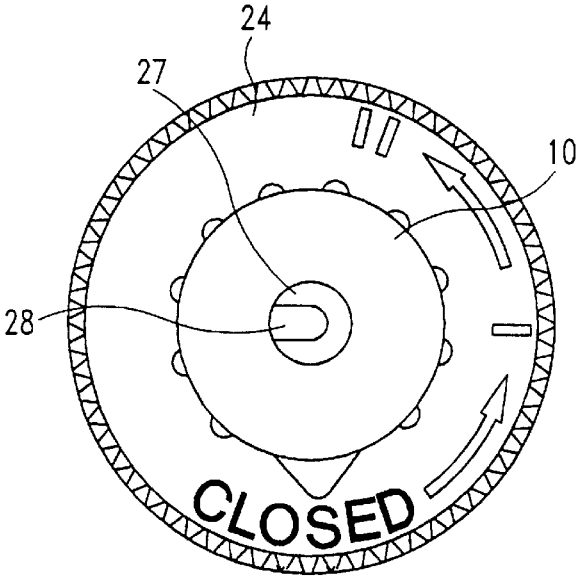
FIG. 4 is a plan view of the closure, depicting the written indication on the post base of the closed, partially (I) and fully opened (II) positions of the post.

At the beginning of the first sloping ramp is a slightly upward turn 51A which helps prevent the closure cap from being unwantedly opened—e.g., from vibration during movement. As the cap is rotated counterclockwise, the cam follower 29 on the central post 20 is pushed down by the cam 50 to a horizontal resting position 52 and along a second sloping ramp 53 to a second resting position 54. Just beyond the second resting position 54 is a perpendicular wall 55 which prevents the cap 10 from opening further and thereby being unwantedly removed from the post 20. Similarly, just before the closed position is a wall 56 which prevents the cap 10 from being twisted in the wrong direction (i.e., clockwise). The resting positions 52 and 54 correspond to dispensing positions I and II respectively. By this construction, "detent" members of the prior art can be obviated, thereby reducing the cost of closure. Experiments have further demonstrated that the cap will remain in a particular position (e.g., position I or II) during dispensing, without the need for such expensive "detent" structures. However, it is useful to know in which dispensing position a closure 1 is at a given moment; the visual indications as shown in FIGS. 1 and 4, have been found to be useful and sufficient in internal testing to accomplish this objective.

Figure 7:
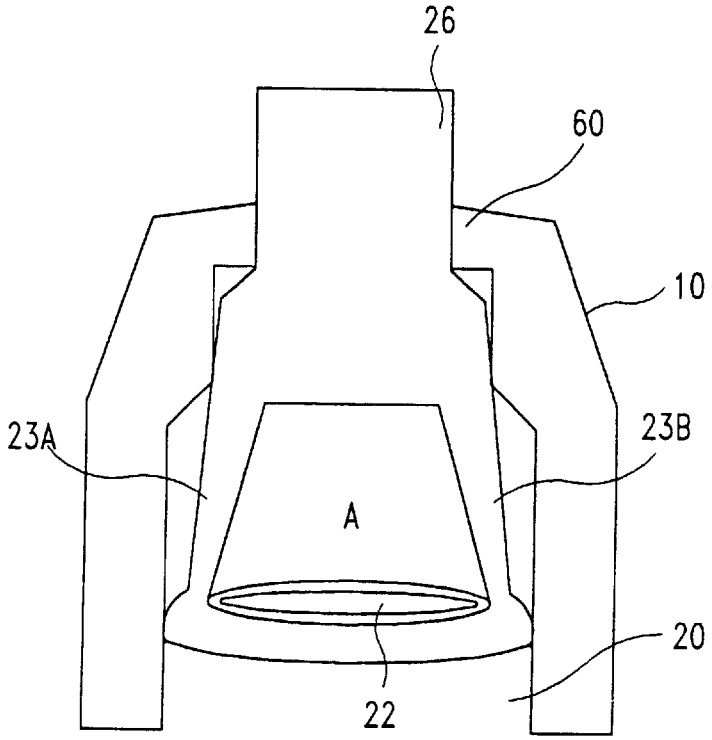
FIG. 7 is an alternate cross-sectional schematic view of another embodiment of the closure depicting an additional slot cut out of the cap.
Figure 8:
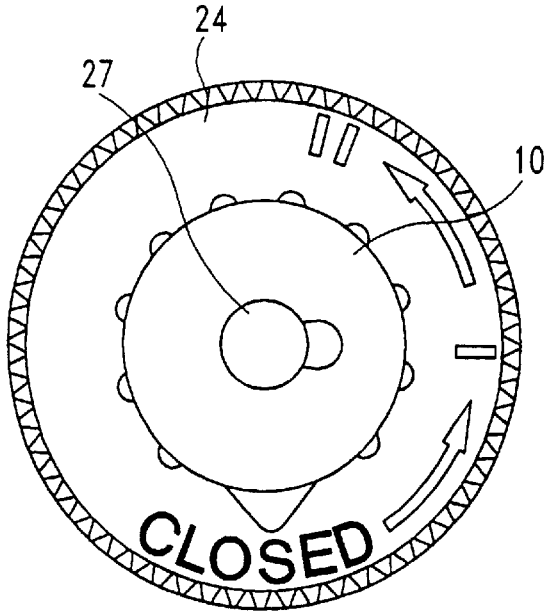
FIG. 8 is a plan view of the closure of FIG. 7.

FIG. 7 depicts yet another embodiment of the invention. In this embodiment, the central post is perfectly round—i.e., it does not have a notch. Rather, there is a notch 60 in the cover cap 10. In this construction, the dispensed material is expelled from the closure 1 slightly off center (see plan view FIG. 8). This embodiment would be useful in instances where the dispenser has, let's say, a clear front orientation and it is desirable the have the orifice pointed in a particular way.

While the preferred and alternate embodiments of the invention have been depicted in detail, modifications and adaptations may be made thereto, without departing from the spirit and scope of the invention as delineated in the following claims:

What is claimed is:

1. A closure for the dispensing of extrudable contents within a dispenser, said closure, comprising:

a post projecting substantially upwardly from a base thereof, said post comprising:

a upper solid portion;

a lower portion having an aperture therethrough; and a cam follower;

a closure cap having an upper and a lower orifice, said cap rotatably mounted for movement along at least a portion of said post, said cap comprising:

a cam for facilitating movement of said cap with respect to said cam follower to facilitate rotation of said cap along said post.

2. The closure of claim 1, further comprising visual dispensing position indication means.

3. The closure of claim 2, further comprising a notch on said upper portion to facilitate multiple dispensing rates of said closure.

4. The closure of claim 3, wherein said multiple rates includes a first rate, wherein said contents are dispensed only out of said notch and a second rate wherein said contents are dispensed out of said upper orifice.

5. The closure of claim 1, wherein said positions include, at least, a closed and first and second dispensing positions.

6. The closure of claim 1, further comprising connecting segments between said upper and lower portions.

7. The closure of claim 6, wherein said connecting segments comprise two angled segments creating a triangular opening therebetween.

8. The closure of claim 2, wherein said visual means comprises at least one of a mark or structure on said cap.

9. The closure of claim 2, wherein said structure is a projecting indicator.

10. The closure of claim 1, further comprising guides on at least one of said cap and post to guide said movement.

11. The closure of claim 10, wherein both said cap and post have said guides.

12. The closure of claim 1, further comprising a cam follower resistor on said cam near a lower most portion thereof.

13. The closure of claim 1, wherein said base has means for improved gripping thereof.

14. The closure of claim 13, wherein said cap has means for improved gripping thereof.

15. The closure of claim 1, wherein said upper and lower portions are substantially cylindrical.

16. The closure of claim 1, wherein said cap is rotated counterclockwise to open and clockwise to close.

17. The closure of claim 1, wherein said post extends beyond top of the cap in the closed position.

18. A closure for the dispensing of extrudable contents within a dispenser, said closure, comprising:

a post projecting substantially upwardly from a base thereof, said post comprising:

an upper solid portion, including a notch to facilitate multiple dispensing rates of said closure connecting segments between said upper and lower portions; and a cam follower;

a closure cap rotatably mounted for movement along at least a portion of said post, wherein said post extends beyond the top of the cap in the closed position, said cap comprising:

a cam for facilitating movement of said cap with respect to said cam follower to facilitate rotation of said cap along said post.

* * * * *